US006138587A

United States Patent [19]

Christmann et al.

[11] Patent Number: 6,138,587

[45] **Date of Patent: *Oct. 31, 2000**

[54] PROCESS AND FURNACE FOR BURNING REFUSE

[75] Inventors: Arvid Christmann, Pulheim; Bernd Rutten, Viersen; Stefan Hartig, Achem; Dieter Wurz, Baden-Baden, all of Germany

[73] Assignee: Deutsche Babcock Anlagen GmbH, Oberhausen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/964,188

[22] PCT Filed: Mar. 22, 1996

[86] PCT No.: PCT/EP96/01254

§ 371 Date: Nov. 4, 1997

§ 102(e) Date: Nov. 4, 1997

[87] PCT Pub. No.: WO96/35081

PCT Pub. Date: Nov. 7, 1996

[30] Foreign Application Priority Data

May 5, 1995 [DE] Germany ..... 951 06 788

[51] Int. Cl.[7] ..... F23J 15/00; F23B 7/00; F23G 7/06; F23L 13/00

[52] U.S. Cl. ..... 110/346; 110/213; 110/214; 110/309; 110/345; 431/10

[58] Field of Search ..... 110/203, 204, 110/205, 210, 211, 213, 214, 248, 297, 309, 310, 345, 346, 348, 255, 257, 235, 185, 190, 224; 431/10

[56] References Cited

U.S. PATENT DOCUMENTS

| | | | |
|---|---|---|---|
| 2,577,659 | 12/1951 | Knipping | 110/257 X |
| 3,937,155 | 2/1976 | Kunstler | 110/255 |
| 3,995,568 | 12/1976 | Dvirka et al. | 110/190 |
| 4,917,026 | 4/1990 | Greenough | 110/346 X |
| 5,007,404 | 4/1991 | Hall et al. | 110/214 X |
| 5,009,173 | 4/1991 | Temelli | 110/346 X |
| 5,181,475 | 1/1993 | Breen et al. | 110/213 X |
| 5,205,227 | 4/1993 | Khinkis et a l. | 110/345 |
| 5,305,698 | 4/1994 | Blackwell et al. | 110/348 |
| 5,313,895 | 5/1994 | Sekiguchi et al. | 110/214 X |
| 5,405,537 | 4/1995 | Goff et al. | 110/346 X |
| 5,527,984 | 6/1996 | Stultz et al. | 110/213 X |
| 5,553,556 | 9/1996 | Kruger | 110/345 |
| 5,694,868 | 12/1997 | Mitthof | 110/345 X |

FOREIGN PATENT DOCUMENTS

| | | | |
|---|---|---|---|
| 606772 | 10/1960 | Canada | 110/224 |
| 0 573 756 A2 | 12/1993 | European Pat. Off. | 110/348 |
| 59-44513 | 3/1984 | Japan | 110/215 |
| 59-147910 | 8/1984 | Japan | 110/211 |
| 3-233207 | 10/1991 | Japan | 110/203 |

OTHER PUBLICATIONS

Meriam–Webster's Collegiate Dictionary, Tenth edition, Merriam–Webster, Inc., Springfield, MA, p. 339, 1996.

*Primary Examiner*—Ira S. Lazarus
*Assistant Examiner*—Ljiljana V. Ciric
*Attorney, Agent, or Firm*—Max Fogiel

[57] ABSTRACT

An arrangement for burning refuse in which the refuse is deposited on a grate and transported to a drop-out shaft. A part of the air supplied for burning the refuse is transmitted as primary air from below the grate. A part of the air is also blown into a combustion chamber as secondary air. The resulting flue gas from the combustion is moved in a direct or parallel stream with the refuse to an end region of the combustion chamber, and deflected in direction and injected through an opening in a flue gas channel having a vertical center plane and two channel halves on both sides of the plane. At least a secondary air stream is blown into blown channel halves in the region of the channel opening, mirror-symmetrically to the center plane. The second air stream is blown in with a rotary pulse relative to a center axis of a cross-section of the channel halves. Two oppositely rotating swirls are generated by the secondary air streams in the channel halves symmetrically to the vertical center plane.

22 Claims, 5 Drawing Sheets

PROCESS AND FURNACE FOR BURNING REFUSE

BACKGROUND OF THE INVENTION

The present invention concerns a process and furnace for burning refuse.

Various types of furnaces—parallel-flow, inverse-flow, and mid-flow—are described and discussed by D. O. Reimann in "Verfahrenstechnik der Müllverbrennung", Die Industriefeurung, Essen, Vulkan-Verlag Dr. W. Classen, 1986, 23–32. Two parallel-flow furnaces are illustrated using schematic drawings. The top of each is in the form of a roof. The inside of the furnace communicates with a flue by way of the grate's burn-out section and its adjacent residue-precipitation shaft. The bottom of the furnace, namely the secondary combustion section, is in one parallel-flow furnace a sloping flue, and the residue-precipitation end roof of the jacket constitutes the floor. The top of the sloping flue communicates with an upright flue, and the flue gas is extensively diverted, especially at the lower edge of the residue-precipitation end roof. The whole flue in the other parallel-flow furnace is upright, although a definite but less extensive diversion is shown at the transition between the inside of the furnace and the flue.

The article devotes considerable attention to the stream of cold flue gas, which flows from the front of the grate, in the vicinity of the charging shaft. It is evident from the drawings that compare the different furnaces that, in a parallel-flow furnace, the cold gas flows to a considerable extent through the hottest part of the combustion section.

When refuse is incinerated in a grated furnace, it is loaded through a refuse-charging shaft and initially dried and heated at the front of the grate. The water evaporates and the burnable components turn into gas. Pyrolysis also occurs in this area, where the temperatures range up to 500° C., It is accordingly of decisive importance, in order to minimize the level of pollutants in the exhaust leaving such a grated furnace on the whole, for the gases and particulate solids that convert into flue gas in the grate's drying and pilot section to be powerfully, turbulently, and intimately combined with the higher-temperature exhaust leaving the grate's actual combustion section. Assuming enough oxygen, both the temperature and turbulence of the flow field and the length of time spent in the vicinity of high temperature and turbulence are of decisive significance to how effectively the organic components are annihilated.

European Patent 0 579 987 A1 describes a rotating-cylinder incinerator with at least two primary-air nozzles aimed toward one another and toward a bed of fuel, generating two opposing vortices inside the cylinder. These vortices rotate around axes paralleling the axis of the cylinder and support the thermally induced motion of the burning gases. A secondary combustion section accommodates auxiliary burners or combined-air nozzles oriented to augment the opposing vortices leaving the cylinder.

SUMMARY OF THE INVENTION

The object of the present invention is to improve the process and the furnace to the extent that every component of the volume of flue gas will be exposed to a high enough temperature for a prescribed length of time.

BRIEF DESCRIPTION OF THE DRAWINGS

Embodiments of the present invention will now be specified with reference to the accompanying schematic drawing, wherein.

DESCRIPTION OF THE PREFERRED EMBODIMENTS

Figure 1:
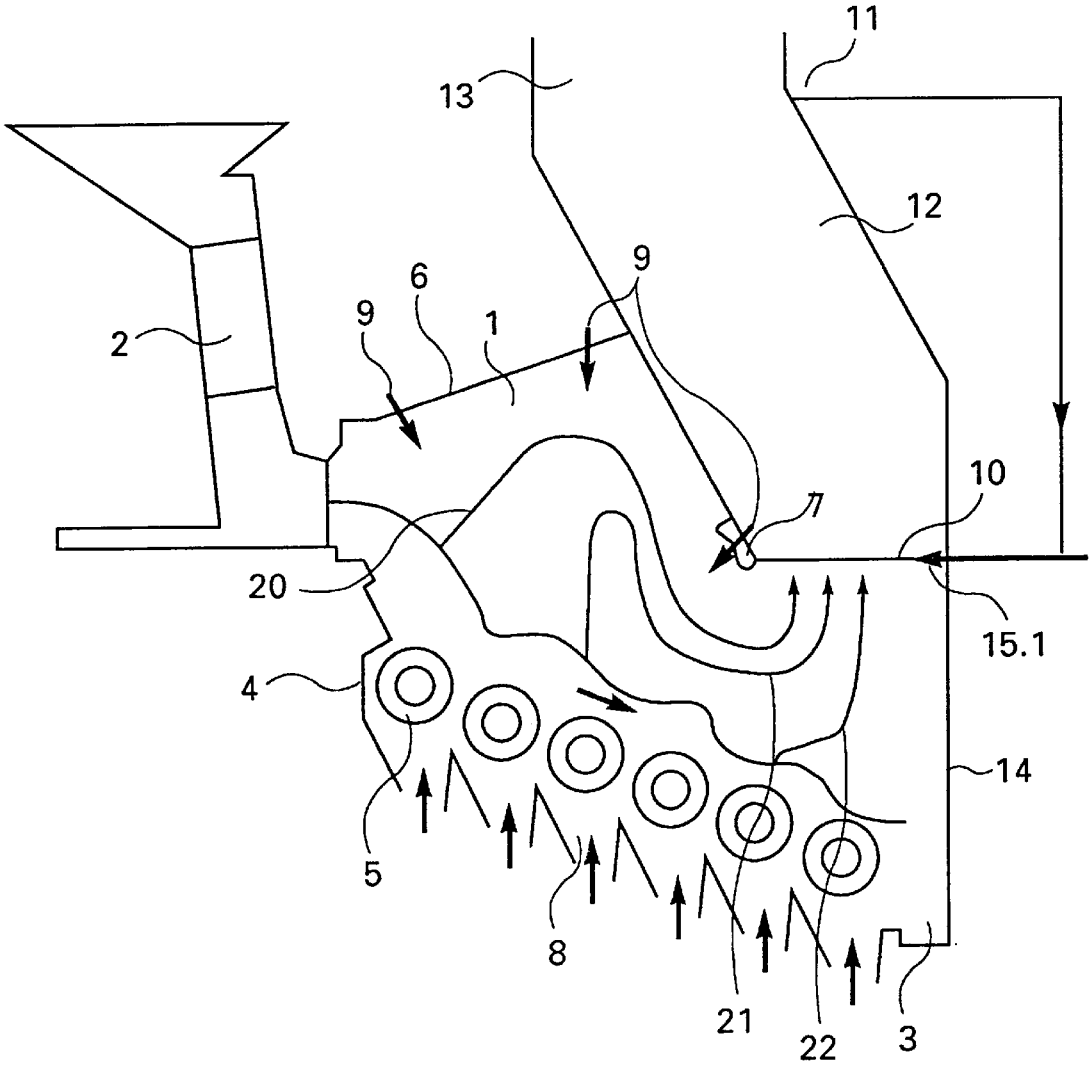
FIG. 1 is a longitudinal section through a parallel-flow furnace.

The parallel-flow furnace illustrated in FIG. 1 as a combustion section 1, a shaft 2 for loading the refuse, another shaft 3 for the residue to precipitate in, and a grate 4. Grate 4 extends from refuse-loading shaft 2 to residue-precipitation shaft 3 and is composed of rollers 5, six in all, with their axes paralleling one another in a plane that slopes toward residue-precipitation shaft 3. The top 6 of combustion section 1 is shaped like a roof. The residue-precipitation edge 7 of top 6 is above the end of grate 4. Also above grate 4 are fittings 8 that inject primary air. Secondary-air injection nozzles 9 extend through the top 6 of combustion section 1 at several points. Nozzles 9 are aimed into the main combustion section, which extends broadly along the mid-line of grate 4. Combustion section 1 communicates with a flue-gas duct 11 by way of an orifice 10 above residue-precipitation shaft 3 and the adjacent end of grate 4. The lower section of flue-gas duct 11 is in the form of a flue 12 that slopes back toward refuse-loading shaft 2. The floor of flue 12 constitutes the residue-precipitation end of the roof-shaped top 6 of combustion section 1. An upright flue 13 communicates with the top of sloping flue 12. The furnace as specified hereintofore is state of the art.

Figure 2:
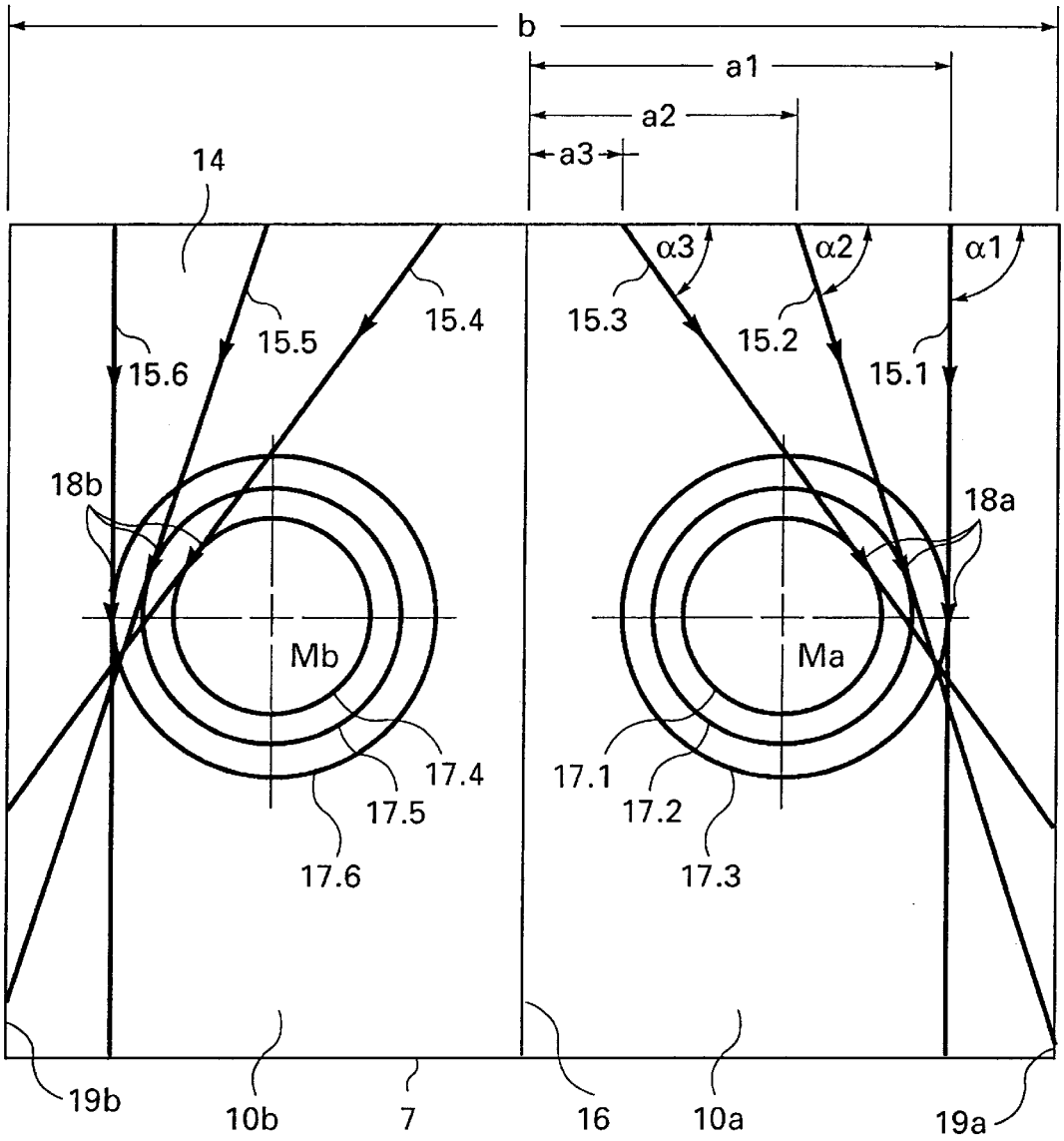
FIG. 2 is transverse section through the flue approximately at the level of its orifice.

Extra nozzles 15.1 to 15.6 are mounted on the back wall 14 of combustion section 1 in a plane represented by the discontinuous line in FIG. 1 approximately on the same level as orifice 10. Nozzles 15.1 to 15.6 are represented by impulse vectors in FIG. 2. The direction of each vector is the direction traveled by the incoming secondary air and the length represents both its force and the size of the nozzle. The vectors in the embodiment illustrated in FIGS. 1 and 2 are all the same length, meaning that all the extra nozzles 15.1 to 15.6 are the same size. The nozzles are arranged mirror-symmetric with respect to a perpendicular midplane 16 that divides the flue-gas duct into the two halves 10*a* and 10*b* represented in cross-section in FIG. 2. Midplane 16 is only conceptual and not an actual partition.

FIG. 2 shows the horizontal components of the impulse vectors. The horizontal components in each half 10*a* and 10*b* are tangent to circles 17.1 to 17.6 inscribed at the center of the half, and accordingly define a sense of rotation 18*a* and 18*b* around the circles' centers Ma and Mb. Due to the symmetrical distribution of the nozzles, the rotation in half 10*a* is opposite the rotation in half 10*b*. The circles 17.1 to 17.3 and 17.4 to 17.6 associated with the nozzles in the embodiment illustrated in FIG. 2 have different diameters. It is, however, alternatively possible for several of the nozzles in one half to be aimed tangent to a single circle. The diameters of circles 17.1 to 17.6 range from approximately 0.15 b to 0.4 b, where b is the width of flue-gas duct 11. The horizontal component associated with nozzles 15.1 to 15.6, which are b/4 or less away from perpendicular midplane 16, is aimed away from midplane 16. The horizontal component associated with nozzle 15.1, which is $a_1$=0.4 b from perpendicular midplane 16, is at a right angle to the back wall 14 of the furnace and parallels wall 19*a*. The same is true of course with respect to nozzle 15.6. The horizontal component associated with nozzle 15.2, which is $a_2$=0.25 b from the midline, is at an angle $\alpha_2$=70° to the back wall 14 of the furnace. For nozzle 15.3, the corresponding distance $a_3$=0.08 b and the corresponding angle $\alpha_3$=50°. The distances can be as much as ±30% and the angles as much as +20% of these values.

Figure 3:
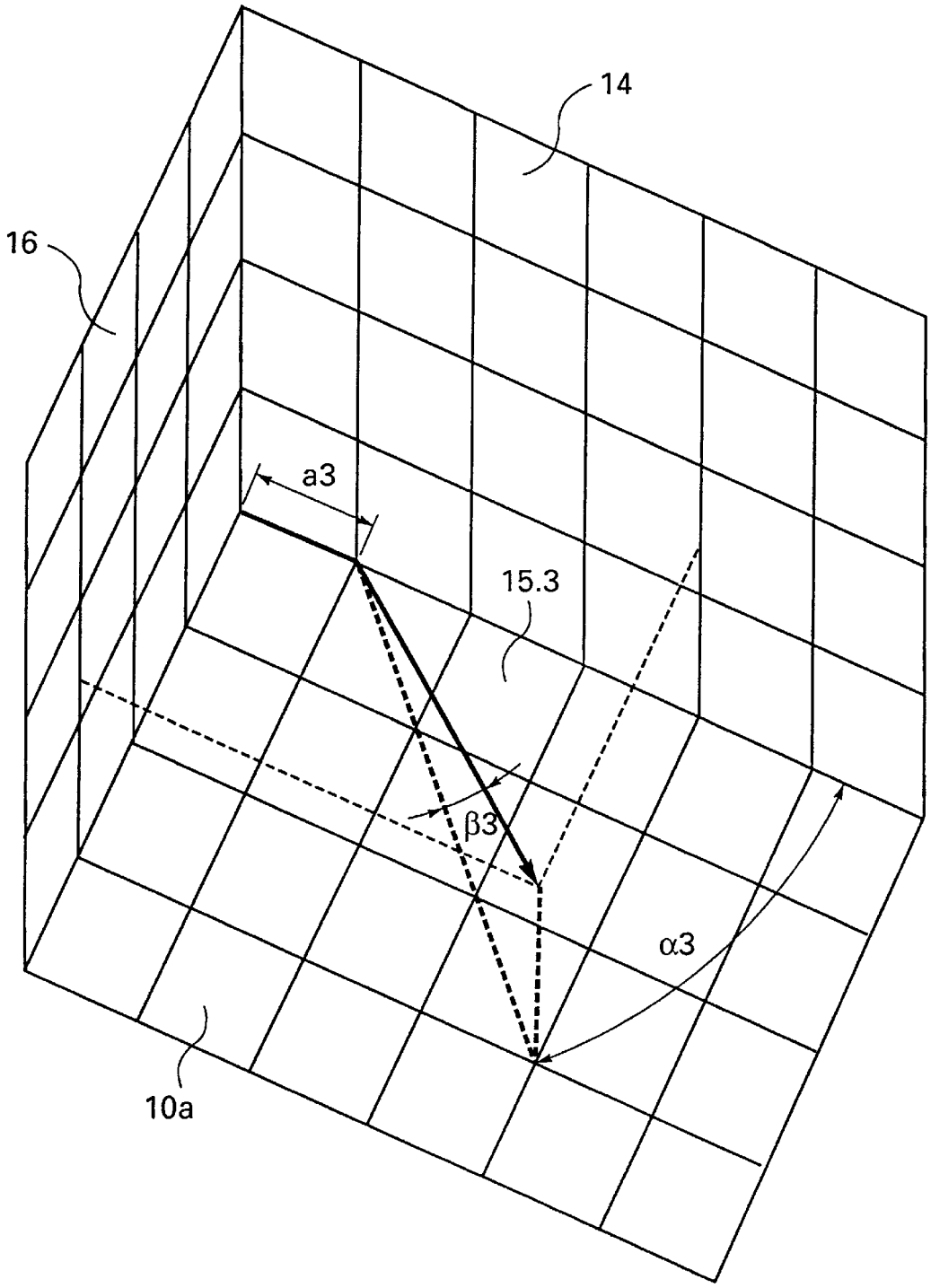
FIG. 3 is a perspective view illustrating how a nozzle is mounted.

Extra nozzles 15.1 to 15.6 are at an angle to the horizontal. As will be evident from FIG. 3, the angle $\beta_3$ of nozzle 15.3 is the angle between the impulse vector and its projection in the transverse horizontal plane of orifice 10. The angles of the other nozzles, which are for simplicity's sake not illustrated, are identical. Generally, the angle β of inclination of any nozzle will be between −20 and +50°, with the minus sign representing a downward inclination. The angles of the nozzles illustrated in FIG. 2 are preferably $$\beta_1=-10\pm20°,$$

$$\beta_2=+10\pm20°, \text{ and}$$

$$\beta_3=+20\pm30°.$$

In operation, the refuse is conventionally supplied to grate 4, advanced along it by the rotating rollers 5, and accordingly thoroughly burned. The residue drops off at the end of the grate. Primary air is supplied to the grate from below and secondary air is blown into combustion section 1 from above.

The flue gas in combustion section 1 begins to flow in currents represented by the lines 20, 21, and 22 in FIG. 1. Current 20 ascends from the front of grate 4 and contains solid and gaseous combustible components. The current is conveyed as is conventional in parallel-flow furnaces through the main combustion section, where the combustible components are extensively burned up at high temperature due to the purposeful injection of secondary air. The current 21 leading the middle of grate 4 is at a very high temperature. The current 22 leaving the end of the grate still contains a lot of oxygen. The overall stream is diverted upward at the residue-precipitation end and arrives in sloping flue 12 through orifice 10, where the entrained combustible components are to be entirely burned, requiring both a sufficient supply of oxygen and thorough mixture of the individual flue-gas currents.

Secondary air is injected in the vicinity of orifice 10 and symmetric to perpendicular midplane 16 in accordance with the present invention. Each jet is oriented to provide an impulse toward the central axis of its associated duct half. This orientation is characteristic of every jet injected into either half. The symmetry results in a rotation in half 10*a* that is opposed to the rotation in half 10*b*. The secondary air is injected into the flowing flue gas at a speed of 70 to 100 m/s. Approximately 25 to 35% of the total secondary air is injected in the vicinity of orifice 10.

The injection of secondary air in accordance with the present invention produces a dual vortex symmetric to the perpendicular midplane 16 of flue-gas duct 11 and especially in sloping flue 12, which constitutes the secondary combustion section. The flue gas leaving combustion section 1 is, due to the distribution and orientation of the nozzles, conveyed up at an angle into sloping flue 12 in the form of two oppositely rotating vortices. It has been demonstrated that the fluidizing vortex observed at the state of the art is completely suppressed or at least reduced to a safely small fluidizing jet directly in the vicinity of the residue-precipitation edge 7 of top 6. Dual-vortex flow on the other hand leads to extensive homogenization with respect to temperature and materials composition, considerably improving the thorough combustion of the entrained combustible components and definitely decreasing the level of pollutants in the exhaust.

Figure 4:
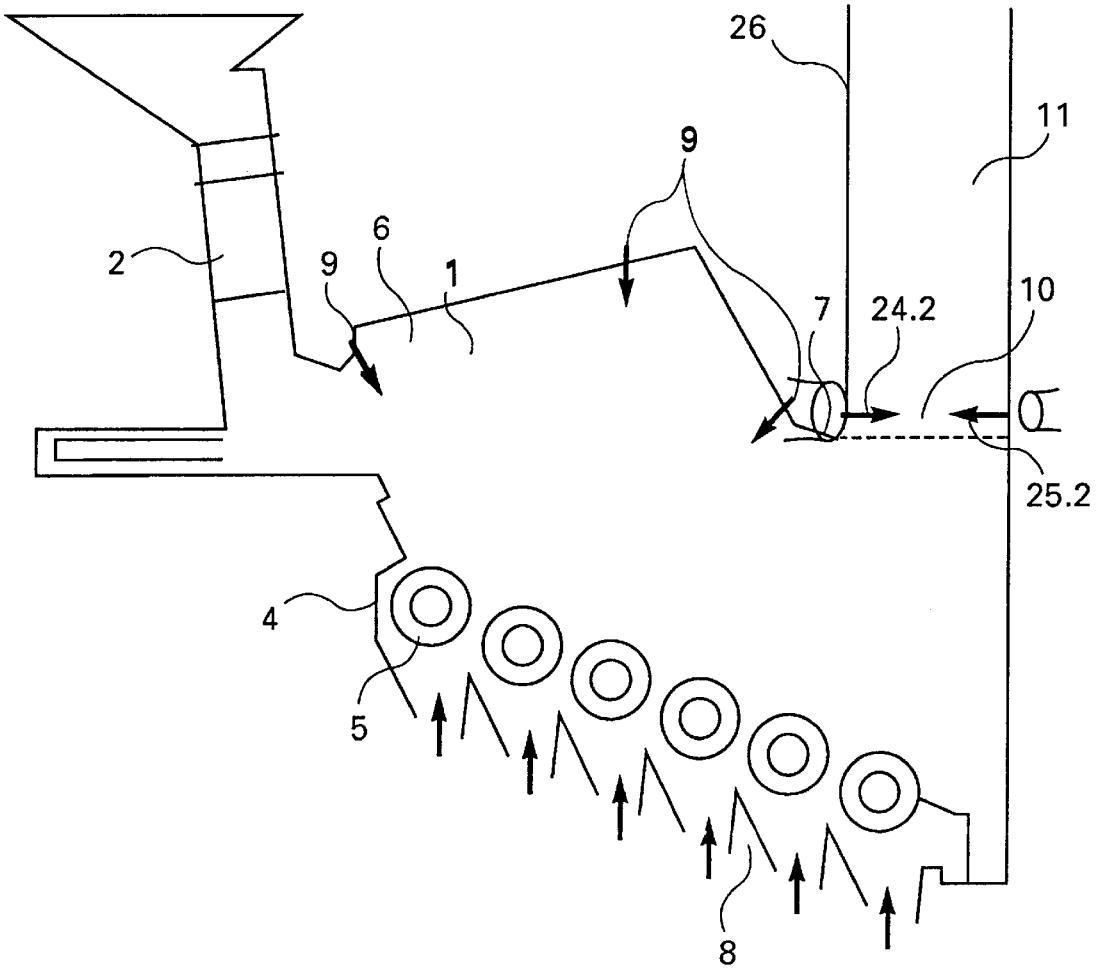
FIG. 4 is a longitudinal section through another parallel-flow furnace.

FIG. 4 illustrates a furnace that essentially differs from the furnace hereintofore specified in two ways. First, flue-gas duct 11 is entirely upright. Second, the nozzles at the level of the orifice 10 in the flue-gas duct have a different configuration. This configuration is illustrated in FIG. 5.

Figure 5:
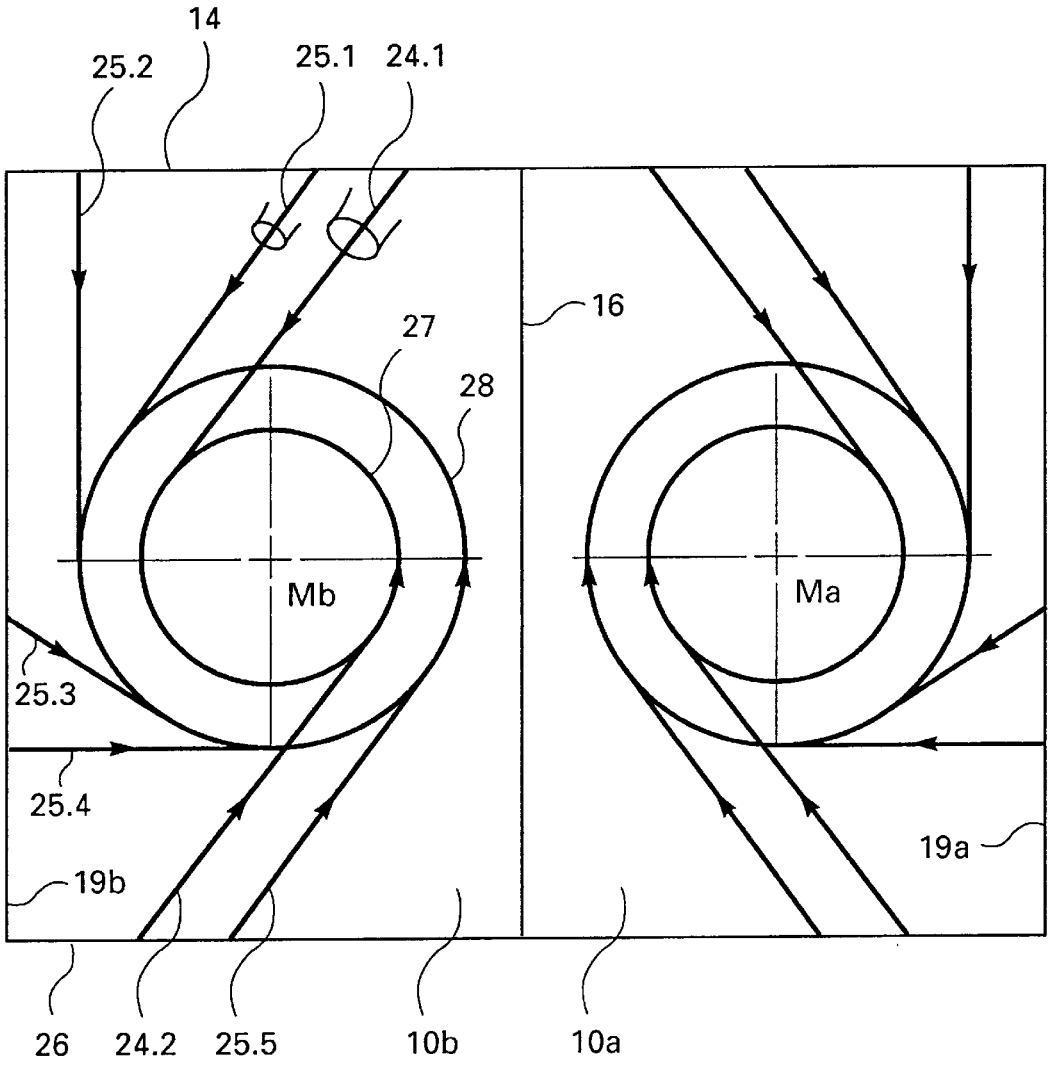
FIG. 5 is transverse section through the flue of the furnace illustrated in FIG. 4 approximately at the level of its orifice.

The nozzles 24.1 and 24.2 and 25.1 and 25.5 illustrated in FIG. 5 are mounted not only on back wall 14 but also on the side walls 19*a* and 19*b* and front wall 26 of flue-gas duct 11 above residue-precipitation edge 7. Nozzles 24.1 and 24.2 are essentially larger than nozzles 25.1 and 25.5. Nozzles 24.1 and 24.2 are tangent to a smaller circle 27 and nozzles 25.1 and 25.5 to a larger circle 28. The angle $\beta_{24}$ of inclination, not shown in FIG. 5, of nozzles 24.1 and 24.2 differs from the angle $\beta_{25}$ of nozzles 25.1 and 25.5.

Secondary air is injected with more force through nozzles 24.1 and 24.2 and accordingly penetrates farther. As much or more secondary air is preferably injected through nozzles 24.1 and 24.2 than through nozzles 25.1 and 25.5. The ratio ranges from 4:1 to 1:1. Some or all of the secondary air can be replaced with recirculated flue gas.

Both a core vortex, generated in particular by nozzles 24.1 and 24.2, and a shell vortex, generated by nozzles 25.1 and 25.5, are produced by the nozzles illustrate in FIG. 5. These vortices have different tangential speeds and, due to the different angles $\beta_{24}$ and $\beta_{25}$, different axial speeds as well, resulting in a shear interface between the two vortices. This results in turn in medium-scale and fine-scale turbulence that contributes to homogenization and to the reaction kinetics.

What is claimed is:

1. A process for burning refuse comprising the steps of: depositing the refuse on a grate; providing a combustion chamber with an end region above said grate; providing a substantially vertical flue gas channel connected to said end region; transporting the refuse on said grate toward a drop-out shaft; supplying air for burning the refuse on said grate and thereby generating combustion residues and flue gas; moving said flue gas in a stream parallel to the refuse towards an end region of said combustion chamber; reversing the direction of said stream in said end region of said combustion chamber and injecting said stream through an opening in said substantially vertical flue gas channel, said flue gas channel having a substantially vertical center plane dividing said flue gas channel into two halves, said flue gas channel having a rear wall and two side walls; supplying a first part of said air as primary air through said grate from below said grate for burning said refuse; blowing a second part of said air as secondary air into said combustion chamber and also blowing a third part of said air as additional secondary air streams into a region of said opening in said substantially vertical flue gas channel; each of said additional secondary air streams being blown mirror symmetrically to said center plane into said flue gas channel, each of said additional secondary air streams having an impulse vector with a horizontal component tangential to an imaginary circle inscribed at the center of a cross-section of a corresponding channel half and defining a rotational direction of the secondary air stream with respect to the center of said circle; each of said additional secondary air streams being blown through said rear wall of said flue gas channel and being oriented toward a space between respective circle centers and an associated one of said side walls, all secondary air streams blown into a channel half having the same rotational direction, air streams in one channel half having a rotational direction opposite to the rotational direction of air streams in the other channel half, said secondary air streams in said channel halves generating two vertical oppositely rotating air swirls which are mirror symmetrical to said substantially vertical center plane.

2. A method as defined in claim 1, including the step of admitting recirculated flue gas.

3. A method as defined in claim 1, wherein 25% to 35% of the total of said secondary air streams are injected in adjacent said opening.

4. A method as defined in claim 1, wherein said secondary air streams are injected at an angle of −20° to +50° to a horizontal.

5. A method as defined in claim 1, wherein a plurality of said secondary air streams are injected into each channel half.

6. A method as defined in claim 5, wherein at least one of said secondary air streams with a first impulse and one of said secondary air streams with a second impulse is injected into each channel half; said first impulse having a greater magnitude than said second impulse.

7. A method as defined in claim 6, wherein at least one secondary air stream with a first impulse is injected between a pair of secondary air streams with a second impulse, said second impulse being higher than said first impulse.

8. A method as defined in claim 6, wherein a secondary air stream with a first impulse is injected at an angle differing from that of a secondary air stream injected with a second impulse; said first impulse being higher than said second impulse.

9. A method as defined in claim 6, wherein a ratio of a secondary air stream injected with a first impulse to a secondary air stream injected with a second impulse is within the range of 4:1 to 1:1; said first impulse being higher than said second impulse.

10. A furnace for burning refuse in a combustion section comprising: a first shaft for loading refuse and a second shaft for precipitating combustion residues; a grate extending from said first shaft to said second shaft and sloping toward said second shaft; a combustion section; nozzles for injecting secondary air into an upper portion of said combustion section; a flue-gas duct with two halves divided by a center plane and communicating with said combustion section through an orifice, said orifice located above said second shaft and said grate; said flue gas duct having two side walls and a rear wall; at least one nozzle near said orifice in each half of said flue gas duct; said at least one nozzle in one of said two halves being arranged mirror-symmetric to said at least one nozzle in the other one of said two halves with respect to said center plane, each of said at least one nozzle being mounted in said rear wall; each of said at least one nozzle being oriented to supply associated air streams having a horizontal component of an impulse vector tangent to an imaginary circle inscribed at a center of a transverse section of a respective half of said flue gas duct and defining a rotation direction about a center of said circle, each of said at least one nozzle being oriented toward a space between respective circle centers and an associated one of said side walls, all nozzles in each of said two halves being oriented to supply associated air streams having the same sense of rotation, the nozzles in one half of said duct being oriented so as to supply associated air streams having a sense of rotation opposite to that of the air streams supplied by nozzles in the other half of said duct.

11. A furnace as defined in claim 10, wherein the nozzles in one half of said duct are arranged mirror-symmetric to the nozzles in the other half with respect to said center plane.

12. A furnace as defined in claim 10, wherein said nozzles are inclined at an angle to a horizontal.

13. A furnace as defined in claim 12, wherein said angle of inclination is in a range from −20° to +50°.

14. A furnace as defined in claim 12, wherein all nozzles are equally inclined.

15. A furnace as defined in claim 10, including an outer wall, said nozzles pointed toward a space between associated circle centers and said outer wall.

16. A furnace as defined in claim 10, wherein the nozzles closer to said center plane have an angle of inclination that is more acute than that of the nozzles farther from said center plane.

17. A furnace as defined in claim 10, wherein one half of said flue gas duct has three nozzles and the other half of said duct has three other nozzles.

18. A furnace as defined in claim 17, wherein for three nozzles 1, 2, 3: $a_1$, $a_2$, $a_3$, is said horizontal component of the impulse vector; b is the width of the flue gas duct; ($\alpha_1$, $\alpha_2$, $\alpha_3$) is the angle of inclination of the horizontal component to a wall mounting said nozzles; ($\beta_1$, $\beta_2$, $\beta_3$) is the angle between the impulses vector and a projection thereof in a transverse horizontal plane of said orifice:

$$a_1/b=0.40\pm30\%,$$

$$a_2/b=0.25\pm30\%,$$

$$a_3/b=0.08\pm30\%,$$

$$\alpha_1=90\pm20^\circ,$$

$$\alpha_2=70\pm15^\circ,$$

$$\alpha_3=50\pm10^\circ,$$

$$\beta_1=-10\pm20^\circ,$$

$$\beta_2=-10\pm20^\circ,$$

$$\beta_3=-20\pm30^\circ.$$

19. A furnace as defined in claim 10, wherein each half of said flue gas duct has at least one first nozzle and at least one second nozzle, said second nozzle having a smaller flow capacity than said first nozzle.

20. A furnace as defined in claim 19, wherein each half of said flue gas duct has at least three nozzles and at least one smaller nozzle between each pair of larger nozzles.

21. A furnace as defined in claim 19, wherein the larger nozzles are tangent to a smaller circle and the smaller nozzles are tangent to a larger circle.

22. A furnace as defined in claim 21, wherein the larger nozzles have an angle of inclination differing from that of the smaller nozzles.

* * * * *